United States Patent [19]

Dreibelbis et al.

[11] Patent Number: 4,679,998

[45] Date of Patent: Jul. 14, 1987

[54] SPINNERET HAVING GROUPS OF ORIFICES WITH VARIOUS INTERORIFICE SPACING

[75] Inventors: Richard L. Dreibelbis; Oliver L. Hunt, both of Waynesboro, Va.

[73] Assignee: E. I. Du Pont de Nemours and Company, Wilmington, Del.

[21] Appl. No.: 887,946

[22] Filed: Jul. 22, 1986

Related U.S. Application Data

[63] Continuation-in-part of Ser. No. 671,920, Nov. 15, 1984, abandoned.

[51] Int. Cl.[4] ..... D01D 5/04

[52] U.S. Cl. ..... 425/72 S; 264/205; 264/211.14; 425/464

[58] Field of Search ..... 264/177.13–177.17, 264/177.19, 211.13–211.17, 204, 205, 237, 345; 425/72 R, 72 S, 192 S, 376 R, 376 A, 378 S, 379 S, 381, 382.2, 461, 464

[56] References Cited

U.S. PATENT DOCUMENTS

| | | | |
|---|---|---|---|
| 2,742,667 | 4/1956 | Clouzeau et al. | 425/464 |
| 2,969,561 | 1/1961 | McCormick et al. | 264/205 |
| 3,094,374 | 6/1963 | Smith | 264/103 |
| 3,342,027 | 9/1967 | Mehler, Jr. | 57/251 |
| 3,428,711 | 2/1969 | Hunt | 525/127 |
| 3,737,508 | 6/1973 | Weir | 264/204 |
| 3,824,050 | 7/1974 | Balk | 425/382.2 |
| 4,248,581 | 2/1981 | Harrison | 425/72 S |
| 4,283,364 | 8/1981 | Capps et al. | 264/211.14 |
| 4,318,680 | 3/1982 | Pfeiffer et al. | 425/464 |
| 4,340,527 | 7/1982 | Martin | 524/432 |

FOREIGN PATENT DOCUMENTS

| | | | |
|---|---|---|---|
| 849420 | 8/1970 | Canada | 425/72 S |
| 536574 | 10/1931 | Fed. Rep. of Germany . | |
| 143434 | 8/1980 | German Democratic Rep. | 425/72 S |

*Primary Examiner*—Jay H. Woo
*Assistant Examiner*—Jill L. Fortenberry

[57] ABSTRACT

The conventional spandex spinneret has two rings of equally spaced grouped orifices, each filament being formed by coalescence of the extrudate from the grouped orifices. A spandex spinneret having the holes of the orifices of each group of the outer ring of groups more closely spaced than those of the inner ring of groups has eliminated the power differences between inner and outer threadlines. The closer spacing within each group of the outer ring of groups also increases the spacing between groups, thereby reducing filament migration.

7 Claims, 3 Drawing Figures

SPINNERET HAVING GROUPS OF ORIFICES WITH VARIOUS INTERORIFICE SPACING

This is a continuation-in-part of application Ser. No. 671,920, Filed Nov. 15, 1984, and now abandoned.

BACKGROUND OF THE INVENTION

This invention relates to dry spinning spandex yarns. More particularly, it relates to a spinneret for obtaining such a yarn.

Smith U.S. Pat. No. 3,094,374 and Hunt U.S. Pat. No. 3,428,711 describe methods for preparing coalesced spandex filaments. In a preferred embodiment described by Smith the yarns contain individual filaments which adhere to one another to form a unitary group of filaments. The Hunt patent which discloses a preferred process for making the filaments in Examples I and II is incorporated herein by reference.

The conventional spinnerets used for light denier spandex production have two rings, i.e., an outer ring and an inner ring of grouped orifices wherein each group is composed of four holes. The spacing between holes of each grouping is the same regardless of whether the group is in the inner or outer ring. The four filaments from each orifice group coalesce as they pass downwardly through the evaporative environment of the spinning cell to form a single end (individual threadline) which is wound onto its separate package. Thus, many individual packages are wound from the yarns issuing from a single spinneret and a single spinning cell.

Higher spinning productivity has been achieved by increasing the number of groups of filaments per spinning cell. The greater number of groups increases the frequency of filament migration between groups. Also, it has now been discovered that yarn ends spun from the inner rings of the spinneret orifice pattern have significantly different power levels from those spun from the outer rings. These end-to-end power differences cause undesirable streaks in fabrics for the following reason. In modern warping operations a plurality of individual yarn packages are placed into a creel and yarn ends are fed side-by-side therefrom onto a beam for shipment to the knitter. The knitter feeds each individual end to each juxtaposed needle of the knitting machine. Thus, each lengthwise wale of the knitted fabric will consist of a yarn end from a different yarn package. Differences of power between juxtaposed yarn ends cause significant differences in knitting tensions which cause undesirable streaks in fabrics.

SUMMARY OF THE INVENTION

A new spinneret for the production of spandex filaments extruded into a cocurrent stream of hot inert gas wherein the orifice spacing of the groupings of the outer ring is substantially less than those of the inner ring has been shown to essentially eliminate power differences between groups. Further, filament migration is reduced thereby increasing yields.

DETAILED DESCRIPTION OF THE INVENTION

Figure 1:
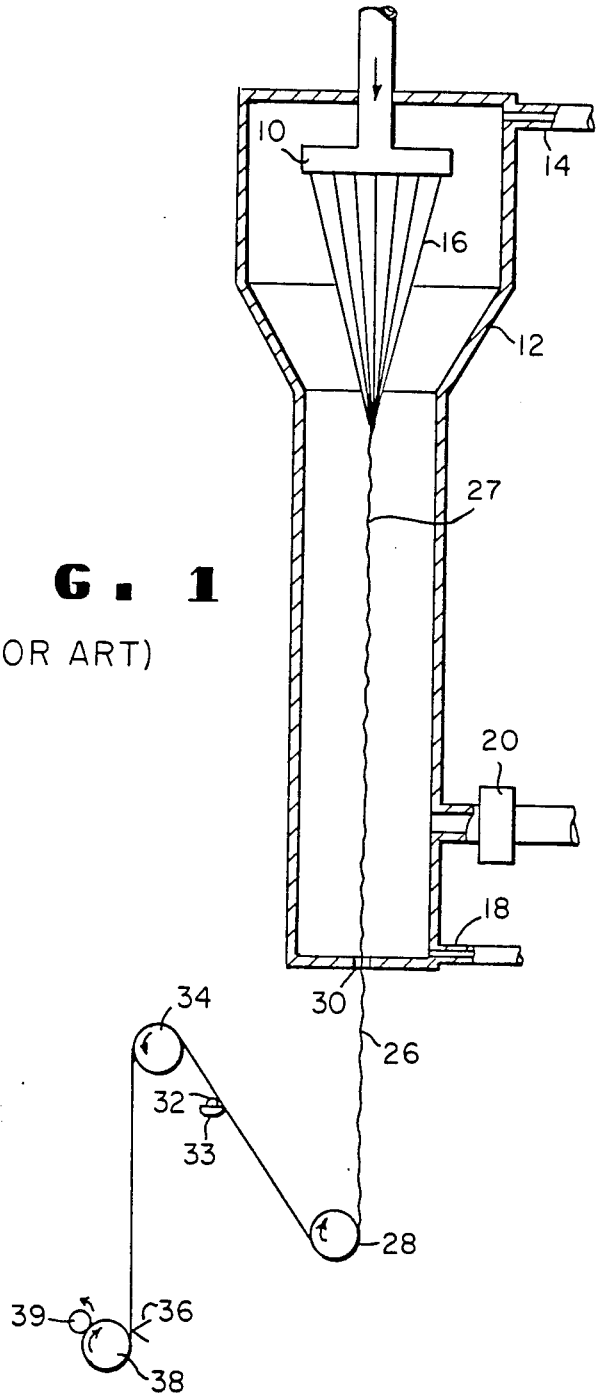
FIG. 1 (PRIOR ART)
FIG. 1 illustrates a prior art spinning apparatus for dry spinning spandex filaments.

Referring to FIG. 1 in the dry spinning of spandex filaments, a solution of the segmented polyurethane is first prepared, preferably by carrying out the polymerization in the solvent to be used for the spinning operation. The spinning solution of suitable viscosity is pumped to a spinneret assembly 10 mounted in the dry spinning cell 12. As the solution is extruded from the spinneret, it is met by a co-current stream of hot, inert gas introduced to the cell through inlet 14. The solvent of the spinning solution is evaporated into the hot, inert gas, thereby converting the several streams of spinning solution into continuous filaments 16 as they proceed down the cell. A counter-current stream of inert gas may also be introduced at the bottom of the cell through inlet 18 to minimize dripping of solvent from the cell. The two streams of inert gas meet and are drawn off through an aspiration device 20 near the bottom of the cell. The solvent may be recovered from the drawn-off gas for reuse in the preparation of additional spinning solution.

The filament bundle 26 exits through a small hole 30 in the cell closure and passes to the feed roll 28. It then passes over a finish roll 32 for application of a lubricant from reservoir 33, thence to a second feed roll 34, and thence to a wind-up apparatus consisting of a traversing yarn guide 36, a drive roll 38, and is wound up on bobbin 39. Roll 34 may be operated at a slightly lower, equal, or slightly higher linear speed than roll 28, depending upon the denier, spinning speed, and spin-stretch ratio desired. The relative speed of these rolls is adjusted to overcome friction encountered while finish is being applied at roll 32. The multifilament may be partially or completely relaxed between roll 34 and roll 38 to give the desired winding tension in the packaged yarn and to develop desirable physical properties in the final product.

Figure 1A:
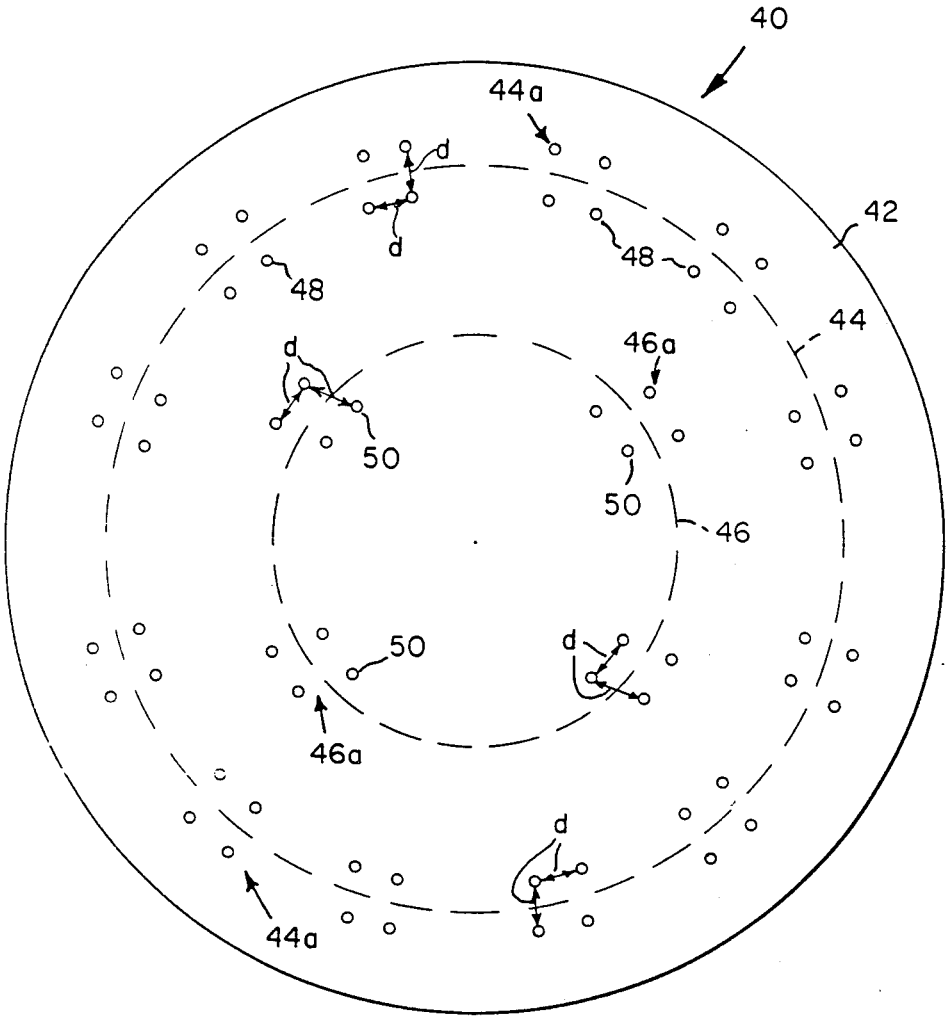
FIG. 1a (PRIOR ART)
FIG. 1*a* shows a plan view of a prior art spinneret used for spandex production.

Referring now to FIG. 1*a*, the prior art spinneret 40 chosen for purposes of illustration includes a plate 42 having an outer ring 44 and an inner ring 46 of grouped orifices 44*a*, 46*a* respectively with each individual orifice in the groups in the outer ring and inner ring designated by the numbers 48 and 50 respectively. The peripheral and radial distances d between orifices of each group 44*a*, 46*a* in the outer and inner rings 44, 46 are the same for both outer and inner ring groups.

Figure 2:
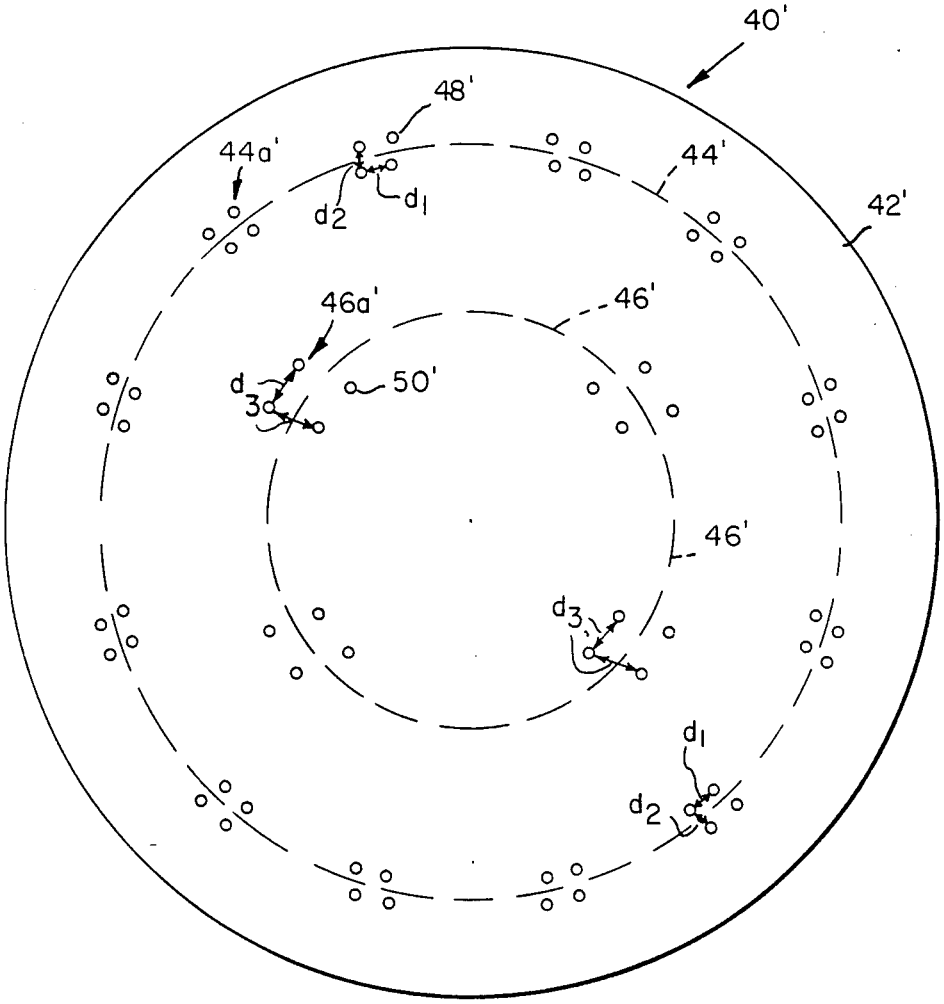
FIG. 2 shows a plan view of a preferred embodiment of the spinneret of this invention for spandex production.

By comparison, the spinneret of this invention is shown in FIG. 2 wherein like numerals for like elements are used. More particularly, the spinneret 40' includes a plate 42' having an outer ring 44' and an inner ring 46' of groups of orifices 44*a*', 46*a*'. As before, each individual orifice is designated 48' and 50' in the outer and inner rings, respectively. The peripheral distance $d_1$ and the radial distance $d_2$ between the orifices in the groups 44*a*'-in the outer ring 44' of groups are the same for each group in the outer ring. In the preferred embodiment shown, $d_1$ is greater than $d_2$. However, each of the distances $d_1$, $d_2$ are less than the distance $d_3$ between the orifices in the groups 46*a*'.

While the preferred embodiment shows $d_1$ to be greater than $d_2$, a spinneret with $d_1$ equal to $d_2$ or $d_1$ less than $d_2$ will perform as well.

In addition, while the preferred embodiment shows four orifices in each group, three orifices in each group will work as well providing the distance between orifices in the groups in the outer ring of groups is less than the distance between orifices in the groups in the inner ring of groups.

LOAD POWER TEST DESCRIPTION

Load power (T300) is stress at 300% elongation. Five samples of spandex yarn each 5" long, are tested at 2" gauge length using an Instron tensile tester at 1000% per minute strain rate. The value in grams (g) of the stress at 300% elongation is reported as load power.

The spinneret described in connection with FIG. 2 has been shown to essentially eliminate load power differences between threadlines or coalesced groups of filaments.

EXAMPLE 1

A spandex spinning solution, prepared as described in Examples I and II of U.S. Pat. No. 3,428,711, was extruded through a 64-hole spinneret to form 16 coalesced threadlines into a dry spinning cell 12 similar to that shown in FIG. 1. The arrangement of holes in the spinneret is shown in FIG. 2. Within each quadrant of the spinneret, there are four groups of orifices, each group made up of four holes. Three of the groups are located equidistant from the center of the spinneret so as to form an outer ring, the remaining group is located between the center and the outer ring. Within each group of orifices of the outer ring, the four holes are spaced approximately 0.20" (5.1 mm) from each other. The hole spacing for the orifices of the inner group is 0.39" (9.9 mm).

The spinning solution was extruded at a rate of 6.2 pph and wound up at about 730 mpm to yield sixteen 40 denier fibers, each fiber formed from 4 coalesced 10 denier filaments. Of the sixteen fibers, twelve are designated outer ring fibers, four are inner ring fibers.

The load power (T300), for inner and outer ring fibers is given in Table 1 in comparison to those of a product from a prior art spinneret of Example 2.

EXAMPLE 2

Example 1 was repeated using a prior art spinneret as shown in FIG. 1. This spinneret has 64 holes, arranged in sixteen groups of four holes. Twelve of the groups form the outer ring, four groups form the inner ring. The spacing between the orifices of each group is 0.39" (9.9 mm) for both outer and inner ring groups.

The load power for inner and outer ring fibers are given in Table 1.

TABLE 1

| Load Power (T300) g. | Example 1 | Example 2 |
|---|---|---|
| Inner | 15.89 | 15.77 |
| Outer | 15.90 | 16.39 |
| Difference, % | 0.06 | 4.0 |

EXAMPLE 3

A 24-thread, 40 denier spandex fiber was produced using a 96-hole spinneret. The 96 holes are divided among 24 groupings, each group having 4 holes. There are 16 outer groupings and 8 inner groupings. Hole-to-hole spacing is 0.32" for both inner and outer threadlines. Solution was fed at a rate of 10.0 pph and fiber wound up at about 814 mpm.

The outer threadline load power (T300) is 16.39 g, the inner threadline retractive load power (T300) is 15.94 g, a difference of 0.45 g.

EXAMPLE 4

Example 3 was repeated using a 96-hole spinneret of this invention wherein the outer hole spacing was 0.20" and the inner hole spacing was 0.35".

Outer threadline load power (T300) was 16.89 g, inner threadline load power is 16.94 g. The 0.05 g difference in threadline retractive load power (T300) is an order of magnitude improvement over the fiber of Example 3.

We claim:

1. A spinneret for the production of spandex filaments extruded into a stream of hot inert gas surrounding the filaments and flowing cocurrently therewith comprising a plate having an outer ring and ah inner ring of circumferentially spaced grouped orifices, each group being comprised of a plurality of orifices spaced from each other, the distance between orifices in each group in the outer ring of groups being less than the distance between the orifices in each group in the inner ring of groups.

2. The spinneret of claim 1, comprising four groups of orifices in the inner ring of groups and twelve groups of orifices in the outer ring of groups.

3. The spinneret of claim 2, comprising four orifices in each group.

4. The spinneret of claim 1, comprising four orifices in each group, the distances between orifices in each group in the outer ring being defined as peripheral and radial distances.

5. The spinneret of claim 4, said peripheral distances being greater than said radial distances.

6. The spinneret of claim 4, said peripheral distances being equal to said radial distances.

7. The spinneret of claim 4, said peripheral distances being less than said radial distances.

* * * * *